United States Patent [19]

Marquiss

[11] Patent Number: 4,856,071

[45] Date of Patent: Aug. 8, 1989

[54] PLANAR LOUDSPEAKER SYSTEM

[75] Inventor: Stanley L. Marquiss, Plymouth, Calif.

[73] Assignee: Electromagnetic Research and Development, Rancho Cordova, Calif.

[21] Appl. No.: 228,487

[22] Filed: Aug. 5, 1988

Related U.S. Application Data

[62] Division of Ser. No. 90,738, Aug. 28, 1987, Pat. No. 4,792,978.

[51] Int. Cl.[4] ..... H04R 7/18

[52] U.S. Cl. ..... 381/203

[58] Field of Search ..... 381/152, 186, 196, 203; 181/144, 147, 148

[56] References Cited

U.S. PATENT DOCUMENTS 3,919,499 11/1975 Winey ..... 381/196

4,210,786 7/1980 Winey ..... 381/203

4,750,585 6/1988 Collings ..... 181/148

*Primary Examiner*—Donald A. Griffin

*Attorney, Agent, or Firm*—Lothrop & West

[57] ABSTRACT

A planar loudspeaker system having an elongated and substantially planar enclosure, configured to house tweeter, midrange, and a pair of upper and lower woofer diaphragms in its median, longitudinal section. A pair of woofer labyrinths, acting as quarter-wave transmission lines, extends throughout the remainder of the enclosure's volume. The labyrinths vent the substantially in-phase backwaves forwardly, toward the listener, through a pair of shared ports in the mid-frontal region of the enclosure. An electro-magnetic drive unit, employing bar magnets, pole pieces and thin encapsulated moving coils, all of elongated and symmetrical configuration, is also disclosed. Three versions of the drive unit are shown, each being adapted to provide a distributive driving force to the planar diaphragms of the loudspeaker.

10 Claims, 9 Drawing Sheets

PLANAR LOUDSPEAKER SYSTEM

This is a division of Serial No. 090,738 filed Aug. 28, 1987 and now U.S. Pat. No. 4,792,978 issued Dec. 20, 1988.

BACKGROUND OF THE INVENTION

1. Field of the Invention

The invention relates generally to the field of loudspeakers employing a plurality of substantially rigid planar diaphragms, driven by cooperating coil and magnet units.

More specifically, the invention relates to a planar loudspeaker system having an elongated and substantially planar enclosure, configured to house tweeter, midrange, and a pair of woofer diaphragms in its median, longitudinal portion. A pair of quarter-wave woofer labyrinths extends throughout the remainder of the enclosure's volume. The labyrinths vent the woofer backwaves forwardly, toward the listener, through a pair of shared ports in the mid-frontal area of the enclosure.

The invention also relates to electro-magnetic drive units which apply a distributive driving force to the planar diaphragms, while presenting a distributive load to the drive amplifiers. Three versions or embodiments of the drive units are disclosed, each of which utilizes bar magnets, pole pieces, and thin encapsulated moving coils, all of elongated and symmetrical configuration, in accordance with the distributive drive and load design.

2. Description of the Prior Art a. Planar Loudspeakers

An overview of planar loudspeaker designs is presented on pages 40–47 of the August, 1987, issue of *Audio*, Audio Publishing, New York, N.Y. While by no means complete, this article does present some of the varied historical and current approaches to constructing and driving, and housing planar diaphragms. However, none of these designs contemplates the particular loudspeaker system disclosed in the following application.

The applicant herein has previously described, in U.S. Pat. No. 4,385,210, an electro-acoustic planar transducer which shares at least some of the characteristics and goals of the loudspeaker system presented herein. Specifically, the transducer disclosed in the '210 Patent uses substantially rigid planar diaphragms, driven by an electro-magnetic drive system. The design taught in the '210 Patent also addresses the "backwave problem", in the particular context of a planar loudspeaker mounted directly upon a rearwardly positioned wall, or other planar surface.

Applicant's prior design, however, was not adapted for multiple transducer systems to be positioned immediately adjacent one another, as the laterally directed backwaves of adjacent systems would not be able to vent properly. Also, in some circumstances, the laterally vented backwaves can induce undesirable resonances in the rear wall upon which the speaker is designed for mounting. Lastly, the stationary coil and moving magnet drive disclosed in the '210 Patent presents such a low impedance to the amplifier, that even current designs for high fidelity amplifiers have considerable difficulty in driving the transducers properly. The planar loudspeaker design herein is directed toward solving each of these issues, while retaining the segmented, rigid planar diaphragm and electro-magnetic drive philosophy associated with the applicant's prior design.

b. Electro-Magnetic, Moving Coil Drive Systems

A summary of the construction and operation of a conventional moving coil/stationary magnet drive system for a direct radiator dynamic loudspeaker is shown on page 337, Section 9.3 of *Music, Physics And Engineering* by Harry F. Olson, Second Edition, Dover Publications, Inc., New York, N.Y. The typical electro-magnetic drive unit shown therein employs a single, conical shaped permanent magnet, a first cylindrical pole piece on the forward end of the magnet, and a second yoke-shaped pole piece, extending from the rear end of the magnet around to the forward portion of the first pole piece. A ring-shaped voice coil, attached to a cone diaphragm, is positioned within a slightly larger aperture of corresponding configuration, located between the adjacent ends of the pole pieces. When an electrical signal is applied to the voice coil, a force to drive the diaphragm is produced by the interaction between the electro-magnetic field and the magnetic flux lines flowing between the pole pieces.

Symmetry is lacking, both in the structure and in the dynamic response of this single magnet, dual pole drive system. It is evident that the first and second poles differ considerably in mass, size and configuration. The resultant flux field, which the coil intercepts and reacts with, is non-linear from front to rear, causing the dynamic response of the loudspeaker to be similarly affected.

This non-symmetrical operation is also inherent in alternative constructions, such as the single ring magnet, dual pole electro-magnetic speaker drive units of more contemporary design. This construction is shown in an article entitled "Rebuilding the AR-1", contained in the February, 1982 issue of SPEAKER BUILDER, Edward T. Dell, Jr., Peterborough, N. H. Again, owing to the differences in mass, size, and configuration of the pole pieces, the driven pistonic action of the moving coil is non-linear.

Another characteristic of both of the aforementioned drive units is their application of drive force through a relatively small implement, namely, the ring-shaped structure supporting and forming the moving coil. While such a structure may be well adapted for driving a cone-shaped speaker diaphragm, it is not particularly suited for driving a large, substantially rigid, planar diaphragm. The obvious expedient of employing a plurality of such moving coil drive units would add considerable weight to the planar diaphragm, and would detract from its ability to respond properly to transients. Furthermore, the application of driving force to the diaphragm would still be made through a relatively small number of pressure points, increasing the likelihood of diaphragm flexure under heavy drive conditions.

Applicant's electro-magnetic drive system addresses the above-mentioned problems of non-symmetrical operation and point application of force in a moving coil/stationary magnet construction. And, the present electro-magnetic drive units are ideally suited to actuate the lightweight, substantially rigid, planar diaphragms of the planar loudspeaker system herein.

SUMMARY OF THE INVENTION

The planar loudspeaker system herein includes a plurality of planar diaphragms housed within separate compartments, all contained within an elongated, substantially planar enclosure. The diaphragm housings, as a group, occupy the median, longitudinal section of the enclosure. Each housing has side walls extending forwardly from the rear wall of the enclosure, and a diaphragm opening adjacent the enclosure's front wall. The collective diaphragm openings define an elongated aperture in the front, or forwardly facing wall of the enclosure.

In the preferred embodiment, an elongated tweeter diaphragm extends along one long side of the aperture, and a pair of upper and lower woofer diaphragms, separated by a midrange diaphragm, occupy the remaining portion of the aperture. Each diaphragm is located within the diaphragm opening of a respective housing, having its opposing planar surfaces facing forwardly toward the listener and rearwardly away from the listener. Each diaphragm is further maintained and supported in that location by means of a resilient and flexible diaphragm surround material, which extends around the periphery of the diaphragm. Thus supported, the diaphragms are adapted for fore and aft pistonic movement; and, when appropriately driven, will generate sound waves within a frequency band dictated by the diaphragm's physical characteristics.

The volume exterior to the diaphragm housings and interior to the loudspeaker enclosure defines upper and lower woofer labyrinths. Each labyrinth is bifurcated, or split, into a pair of tubes or tunnels, so that the overall configuration of each labyrinth resembles the letter "U". The upper labyrinth is vertically aligned, and inverted in orientation, with respect to the lower labyrinth. The end extremities of opposing labyrinth tubes terminate at shared labyrinth ports, located in the median portion of the front wall, on opposing sides of the elongated aperture. Upper and lower woofer vents, located respectively, within the side walls of the upper and lower woofer housings, admit the woofers' backwaves into the median, or middle portion of a respective labyrinth. From there, the backwaves travel through each respective tube to the terminus, where they meet the in phase backwave from an opposing tube, and emerge together through the common port. Owing to the physical characteristics of the labyrinths, the forwardly, directed backwaves are substantially in phase with the woofers' front waves, augmenting the overall bass response of the system.

The labyrinths are filled with wool, or other appropriate sound absorptive material, to attenuate the amplitude of the midrange frequencies contained in the backwaves. The wool also acts to retard the speed of the backwaves which ultimately emerge at the ports. The effective length of each labyrinth tube or tunnel is selected to be approximately one-quarter of a wavelength of the lowest frequency at which the woofers are designed to generate an appreciable amount of low frequency response.

The tweeter and midrange diaphragm housings are sealed, with exception of the frontal opening where each diaphragm is located. Sound absorptive material partially fills the volume of the housings behind these diaphragms, to dampen the diaphragm action while absorbing the backwave.

A symmetrical and distributive electro-magnetic drive system is contained within each diaphragm housing, to place each diaphragm into fore and aft pistonic motion, in response to an impressed electrical signal. Each diaphragm is driven by a plurality of elongated coil and magnetic units, interconnected in series - parallel fashion to present an appropriate load impedance of very low inductive reactance to the drive amplifier.

In its simplest configuration, each drive unit includes at least a pair of elongated bar magnets, oriented with their longitudinal axes in parallel, and their upper and lower pole faces being both coplanar and of opposite pole polarity with respect to each other. Further, their adjacent longitudinal sides are spaced apart a predetermined distance to define an elongated flux aperture.

Ferrite planar pole pieces are substantially coextensive with and attached to the upper and lower pole faces of each magnet, to concentrate and focus the upper and lower flux lines flowing between the opposite poles of the adjacent magnets and across the flux aperture. The inner, adjacent edges of opposing pole pieces are preferably slightly closer with respect to each other than the magnets themselves, to enhance the density of the flux lines. The bar magnet and pole piece assemblies are rigidly attached to the diaphragm housings, by means of various support pieces and cross-members.

An elongated coil, arranged in planar configuration, is positioned within the elongated flux aperture, and is adapted transversely to intercept the upper and lower flux lines. A rigid, lightweight, and insulative encapsulating material is employed both to maintain the coil in the desired configuration and to interconnect the coil assembly physically with the rear surface of the adjacent diaphragm. Accordingly, when an electrical signal is applied to the coil, the diaphragm is alternatively driven forwardly and rearwardly to create sound waves.

A plurality of coil and magnetic units is arranged generally upon a median, longitudinal portion of each respective diaphragm, extending substantially its entire length. The distributive application of driving force upon the elongated central region of each diaphragm ensures that the diaphragm excursions are linear, and pistonic in nature. The previously mentioned diaphragm surround, extending around the entire periphery of each diaphragm, maintains a degree of control over diaphragm excursions as well as establishing an "at rest", or normal position for the diaphragm and the connected coil assembly.

The preferred embodiment of the coil and magnetic drive unit contemplates a construction similar to that already described, with the addition of another bar magnet and pole piece assembly adjacent and parallel to the existing pair, defining a second elongated flux aperture to accommodate a second coil assembly. To generate the proper flux patterns, the pole polarity of the added magnet is identical to that of the remote magnet, and thus opposite to that of the adjacent magnet. The newly added coil must also be driven out of phase with respect to the adjacent coil drive, to cause the new coil and support structure to react in phase with the adjacent coil and support structure.

A third version of the magnet and coil drive is a natural extension of the first two embodiments, already described. Rather than employing a single pair of bar magnets, the third version uses two stacked pairs of magnets. And, since three-distinct lines of flux are created by the quadruplet of magnets, the coil assembly positioned within the flux aperture includes a pair of stacked, elongated coils, having adjacent turns of wire of each coil overlapping. The coil assembly thus presents upper, intermediate, and lower turns of wire in a plane substantially intersected by a respective one of the three lines of flux. This third version of the electromagnetic drive is particularly well suited for diaphragms having a larger mass and planar surface, or requiring an extended diaphragm excursion range.

DETAILED DESCRIPTION OF THE PREFERRED EMBODIMENT

Figure 1:
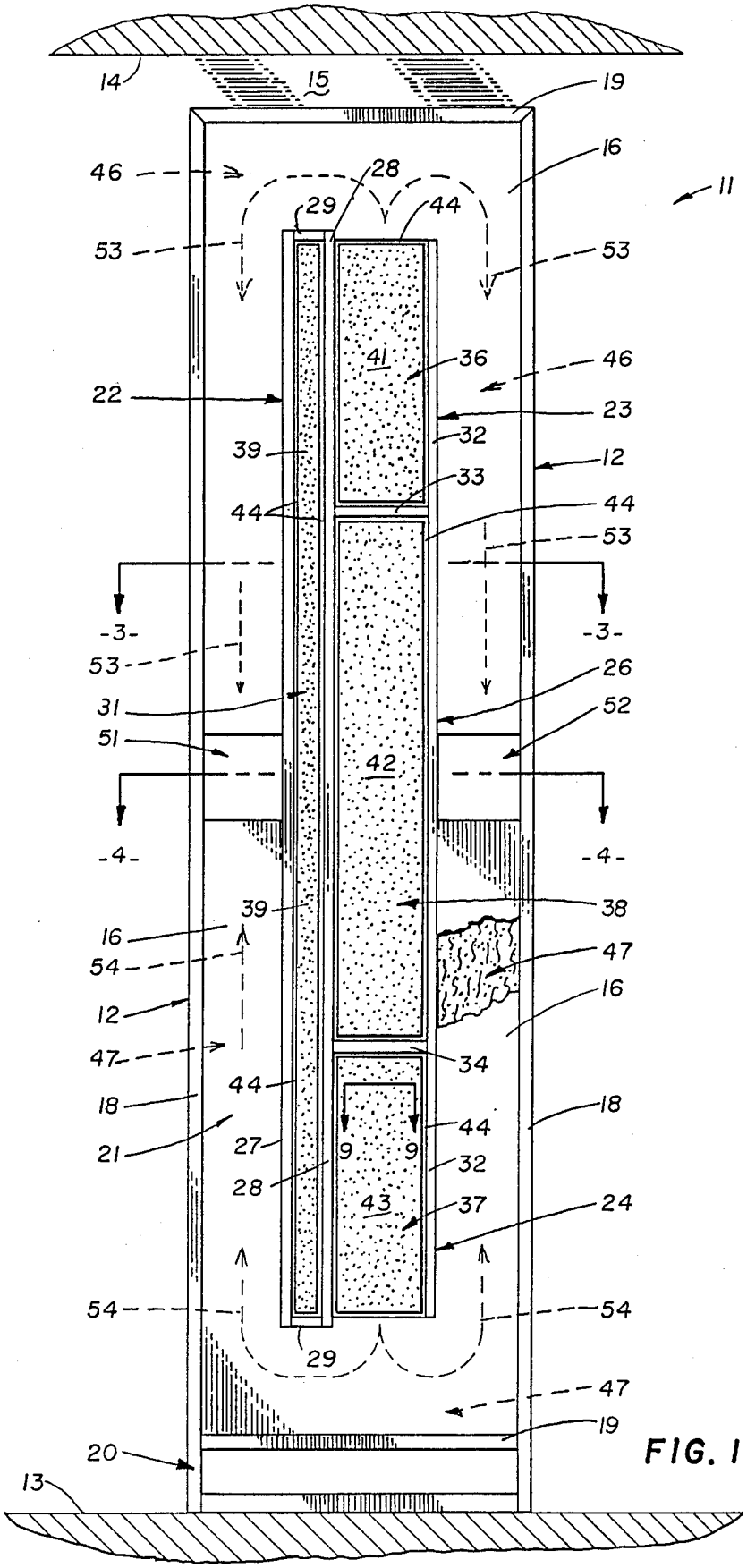
FIG. 1 is a front elevational view of the preferred embodiment of the invention, with the front grill cloth being entirely removed to show the diaphragm housings, the diaphragms, and the woofer labyrinth ports, a portion of the front wall being broken away to reveal the sound absorptive material within one tube of the lower woofer labyrinth.

The planar loudspeaker 11 of the present invention includes an elongated, substantially planar enclosure 12, or exterior housing, with its lower end preferably resting upon the floor 13 and extending substantially the height of the room so that its upper end is adjacent the ceiling 14. The enclosure 12 has a front wall 16 and a parallel rear wall 17, spanned and joined together by peripheral side walls 18 and peripheral end walls 19 (see FIGS. 1 and 3). Rear wall 17 abuts and is parallel to the surface of room wall 15. A base 20, or pedestal, having a flared footing for stability, is provided at the lower end of the loudspeaker enclosure 12, to support the loudspeaker securely upon the floor 13.

Located within the median, longitudinal portion of the enclosure 12 is a diaphragm housing assembly 21, including a tweeter housing 22, an upper woofer housing 23, a lower woofer housing 24, and a midrange housing 26. As is evident most clearly in FIG. 1, the forwardmost portion of the diaphragm housing assembly 21 defines an elongated aperture in the front wall 16. The tweeter housing 22 is located along one long side of the elongated aperture, and has closed side walls composed of first and second elongated pieces 27 and 28 spanned at their end extremities by transverse pieces 29. The pieces 27, 28 and 29 extend forwardly from the rear wall 17 (see FIGS. 1, 2 and 3), to define a tweeter opening 31 (see FIG. 3) adjacent the front wall 16.

Upper woofer housing 23 and lower woofer housing 24 are located along the other long side of the elongated aperture, both woofer housings similarly having side walls extending forwardly from the rear wall 17. Making reference to FIG. 1, it is evident that the side walls of the woofer housings are formed on one side by the second elongated piece 28 of the tweeter housing 22, and on the other side by a third elongated piece 32. The closed ends of the woofer housings are formed by an upper cross piece 33 and a lower cross piece 34. The forwardmost edges of the cross piece 33 and the upper portions of pieces 28 and 32 define an upper woofer opening 36; and, in like fashion, the forwardmost edges of the piece 34 and the lower portions of pieces 28 and 32 define a lower woofer opening 37. Both woofer openings 36 and 37 are adjacent the front wall 16 of the enclosure 12.

The midrange housing 26 is interposed between the upper and lower woofer housings, and has closed side walls like those of the tweeter housing previously described. The closed side walls of the midrange housing 26 are formed by pieces already generally identified, namely, the middle portions of the second and third elongated pieces 28 and 32, and the cross pieces 33 and 34, all extending forwardly from the rear wall 17. The forwardmost edges of each of these wall pieces define a midrange opening 38, adjacent the front wall 16, as shown in FIG. 1.

The loudspeaker 11 further includes a tweeter diaphragm 39, an upper woofer diaphragm 41, a midrange diaphragm 42, and a lower woofer diaphragm 43. Each diaphragm is constructed from a lightweight, substantially rigid material, which is also non-conductive and acoustically impermeable. Rigid foam material, such as "ROHACELL" Type 51, manufactured by Cyro Industries, of Orange, Conn., has proven satisfactory for this application, although other materials meeting the basic requirements set forth above should also perform well. Since the diaphragms are relatively large, thin, and elongated in configuration, the diaphragms must be sufficiently rigid to avoid bending or flexing, while remaining light enough to be driven quickly and efficiently by an electrical drive system and the associated drive amplifier. It has been determined that, where "ROHACELL" is used as a diaphragm material, a diaphragm thickness of 6.35 mm ($\frac{1}{4}''$) or so, represents a suitable compromise between the existing rigidity and weight requirements.

Each diaphragm is situated within a respective opening existing in the forwardmost portion of its housing as previously set forth above. Thus, as most clearly appears in FIG. 3, the tweeter diaphragm 39 is mounted and maintained within the tweeter opening 31, primarily by means of a diaphragm surround 44 that extends around the periphery of the diaphragm, forming a pliant and acoustically impervious bridge between the tweeter 39 and tweeter housing 22. The surround 44 thereby allows the tweeter diaphragm freedom of movement, while providing an efficient acoustical seal between the tweeter and its close walled housing 22.

Figure 3:
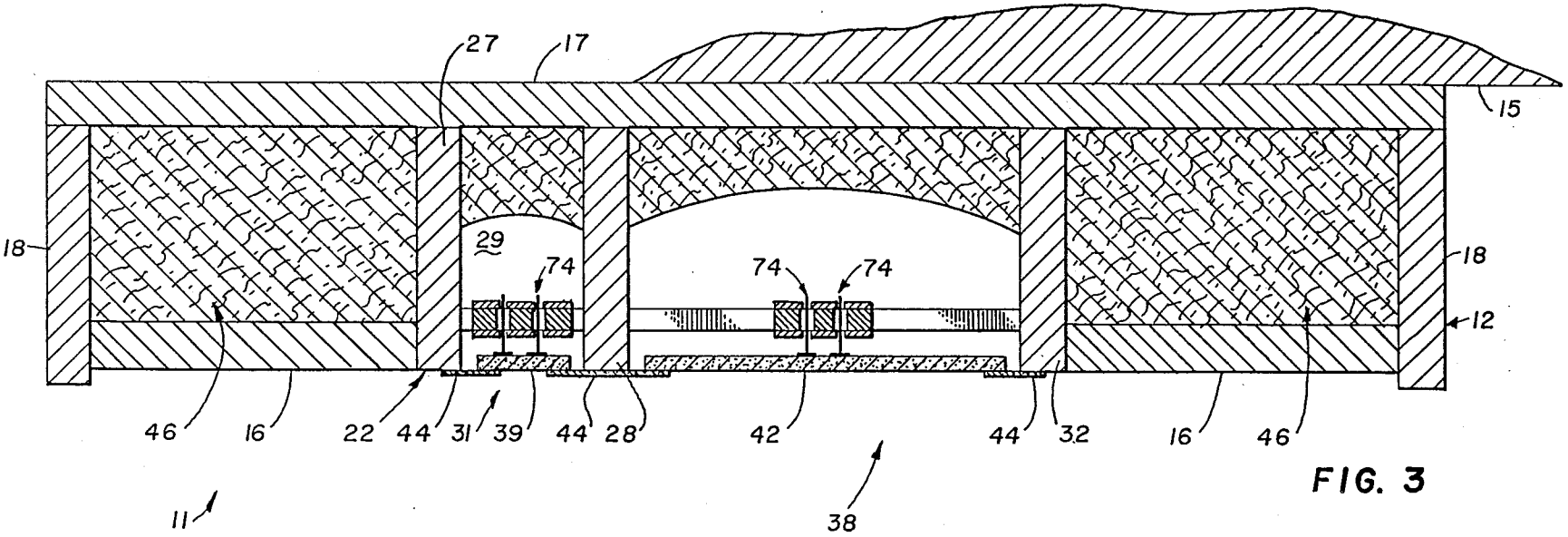
FIG. 3 is a transverse, cross-sectional view, to an enlarged scale, taken on the plane indicated by the line 3—3 in FIG. 1.

Similarly, the midrange diaphragm 42 is mounted within the midrange opening 38, the upper woofer diaphragm 41 is maintained within the upper woofer opening 36, and the lower woofer diaphragm 43 is situated within the lower woofer opening 37, all by means of peripheral diaphragm surround 44 extending between each diaphragm and the adjacent forwardmost surface of a respective housing (see FIGS. 1 and 3).

Figure 4:
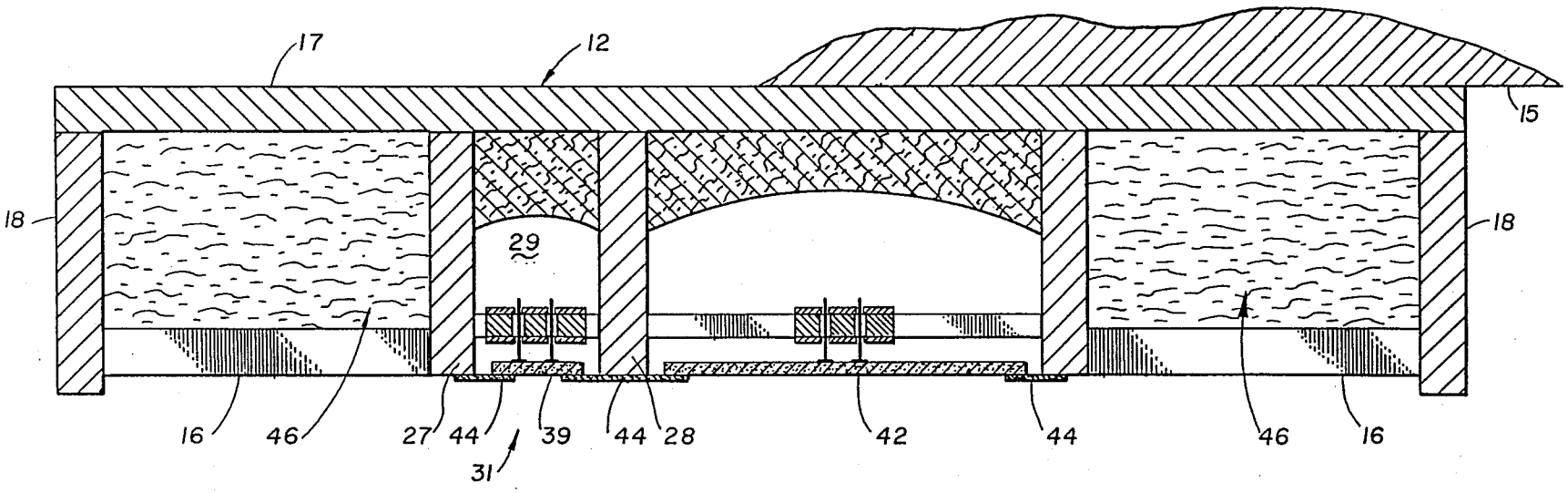
FIG. 4 is a transverse, cross-sectional view, to an enlarged scale, taken on the plane indicated by the line 4—4 in FIG. 1.

Upper woofer labyrinth 46 and lower woofer labyrinth 47 are also provided within the enclosure 12. These labyrinths are defined by the volume exterior to the diaphragm housing assembly 21 and interior to the enclosure 12. The upper labyrinth 46 begins in the region immediately exterior to the upper end of the upper woofer housing 23, then proceeds to split into two tunnels or tubes extending downwardly along either side of the housing assembly 21. These tunnels are generally rectangular in cross section, as shown in FIGS. 3 and 4. Similarly, the lower labyrinth 47 begins in the contained volume just below the lower end of the lower woofer housing 24, and then bifurcates into a pair of tunnels or tubes extending upwardly along both sides of the housing assembly 21.

Figure 2:
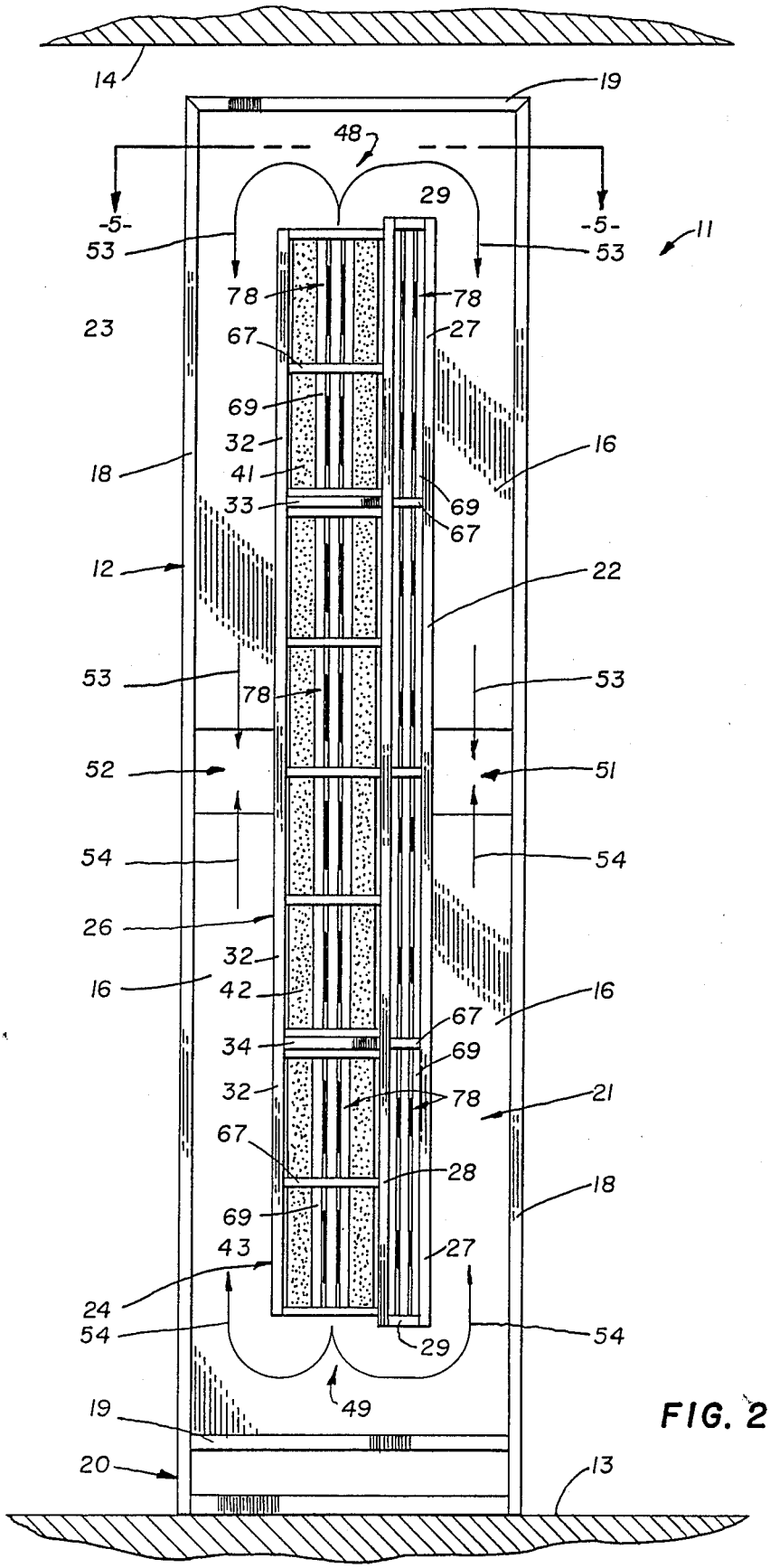
FIG. 2 is a rear elevational view of the invention with the rear wall, and all sound absorptive material within the tweeter housing, the midrange housing, and the upper and lower woofer labyrinths, being removed for clarity.
Figure 5:
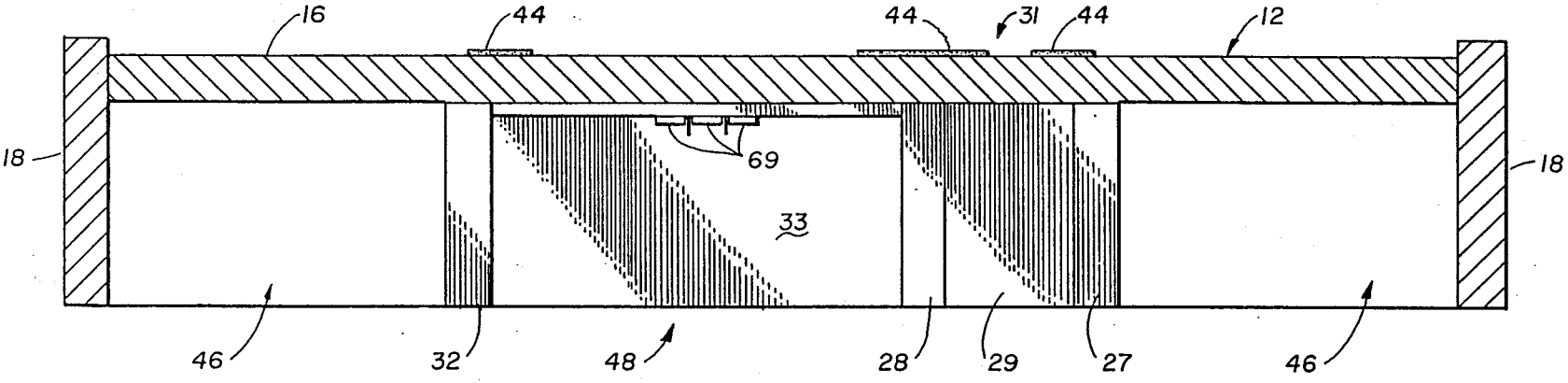
FIG. 5 is a transverse cross-sectional view, to an enlarged scale, taken on the plane indicated by the line 5—5 in FIG. 2.

An upper woofer vent 48 and a lower woofer vent 49 are provided, respectively, in the uppermost and lowermost side walls of the upper woofer housing 23 and the lower woofer housing 24 (see FIGS. 2 and 5). Vents 48 and 49 are generally rectangular in configuration, and are adapted to pass each woofer's backwave into a median, or middle portion of a respective woofer labyrinth. From there, each backwave bifurcates to travel through the pairs of labyrinth tunnels, straddling each side of the diaphragm housing assembly 21. As is evident from FIGS. 1 and 2, each labyrinth is thus configured to resemble the letter "U", the upper woofer labyrinth 46 being vertically aligned and inverted in orientation with respect to the lower woofer labyrinth 47. The terminus, or end extremity of each woofer labyrinth tunnel meets a respective end of the labyrinth tunnel of the other woofer, in shared or common woofer labyrinth ports 51 and 52. FIGS. 1 and 2 show the ports 51 and 52 to be located in the median portion of the front wall 16, on opposing sides of the diaphragm housing assembly 21.

Directive arrows 53 and 54, shown in broken line in FIG. 1 and in solid line in FIG. 2, trace the paths of the upper woofer backwaves and the lower woofer backwaves. The backwaves initially vent into the middle portion or volume of a respective labyrinth, then divide to pass through the adjacent labyrinth tunnels, and finally meet the opposing in phase backwave of the other woofer, to emerge forwardly toward the listener, through the woofer ports 51 and 52.

The design of the upper and lower woofer labyrinths 46 and 47 is such that each acts as a quarter-wave transmission line, constructively to vent the backwaves of the planar woofers from the middle portion of the planar loudspeaker 11, toward the listener. The total length of each leg or component of the woofer labyrinths herein, is selected to be approximately one-quarter of a wavelength of the lowest frequency at which the woofers are expected to generate an appreciable amount of low frequency information. Thus, for example, the distance from the upper woofer vent 48 through a labyrinth tunnel to a respective port would be around 1.22 to 1.52 meters (four to five feet), or so.

As is well known in the art, by filling such a transmission line with sound absorptive damping material, such as wool, fiberglass or "DACRON", the effective length of a transmission line can be extended somewhat, since the sound waves are slowed down by passing through the material. In addition, such damping material acts to attenuate the backwave, particularly the lower midrange and midrange frequencies. So designed, the woofer labyrinths of the present invention provide substantially in-phase augmentation of the lower frequency frontal waves generated by the woofer diaphragms. In other words, there is constructive interference in the listening zone between the "direct" frontal sound waves, generated by the forward surface of each woofer, and the "indirect" rearward sound waves, generated by the rear surface of each woofer.

In addition to length considerations, the labyrinth tubes or tunnels, as well as the labyrinth ports, should be of sufficient cross-sectional area, so as to prevent substantial back pressure or resistance, to the outward flow of the woofer backwave. Since the design herein contemplates pairs of identical tunnels or tubes for each labyrinth, and a pair of identical ports for releasing the in-phase backwaves from the enclosures, the effective cross-sectional area for the labyrinth passage is doubled. It is preferable that the total cross-sectional area, both for the labyrinth passage and for the port, be the same or larger than the working area of the woofer diaphragm whose backwaves are to be vented. While it is not practical in all cases to achieve such a ratio, as size restrictions of the enclosure come into play, it is important that the ratio be maintained as close to 1:1 as is possible.

Having presented the basic construction of the enclosure, the diaphragms, the diaphragm housings, and the woofer labyrinths, the discussion will now focus on the electro-magnetic drive units designed to actuate the planar diaphragms of the present invention.

Figure 7:
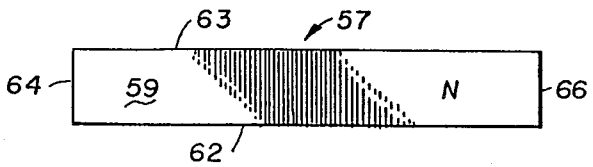
FIG. 7 is a top plan view to a reduced scale of a bar magnet.
Figure 8:
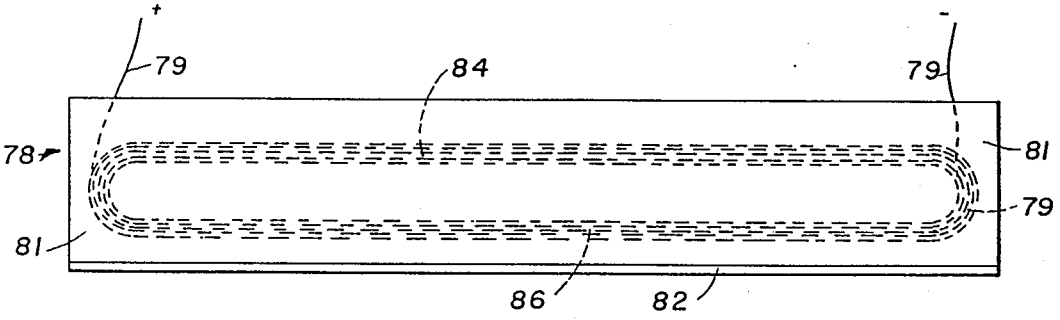
FIG. 8 is a side elevational view to a reduced scale of the elongated moving coil assembly of FIG. 6, the encapsulated portion of the oval coil being shown in broken line.
Figure 6:
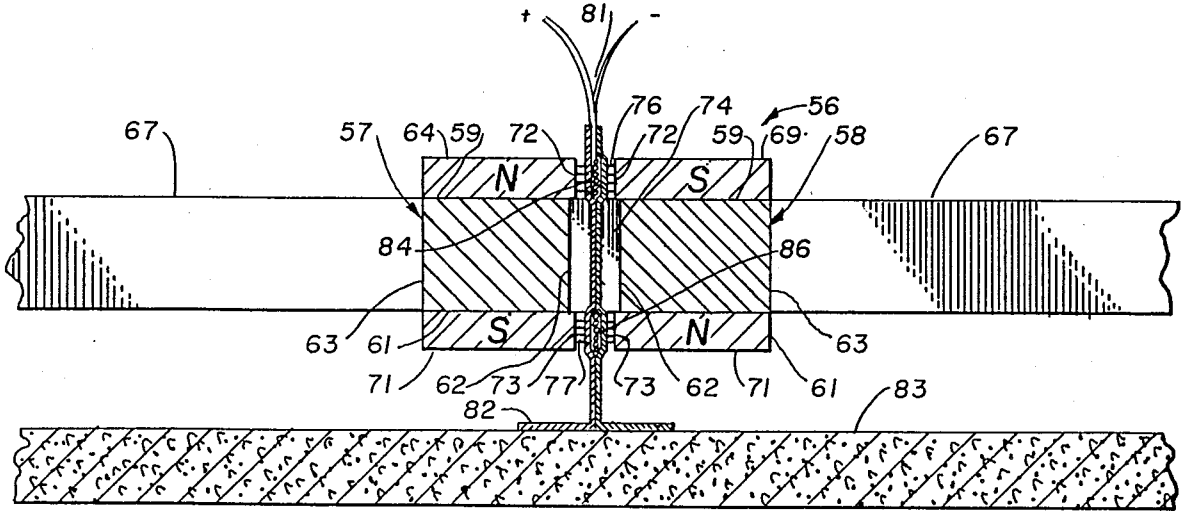
FIG. 6 is a transverse, cross-sectional view, taken to an enlarged scale, of one version of the electro-magnetic drive system, showing fragments of an associated support piece and planar diaphragm.

FIGS. 6, 7 and 8 show the first and most basic configuration of an electro-magnetic drive unit 56. The drive unit 56 includes a pair of substantially identical, elongated bar magnets 57 and 58, having upper and lower longitudinal faces 59 and 61, adjacent sides 62 and remote sides 63, and opposing transverse ends 64 and 66. Magnets 57 and 58 have opposing magnetic poles situated upon their respective longitudinal faces, and these poles are indicated in the drawings by the letters "N" for "North", and "S" for "South".

Mounting pieces are used to support and maintain the magnets 57 and 58 upon the frame of the loudspeaker. Although, typically, a pair of such mounting pieces is used, only a single mounting piece 67 is shown in the fragmentary cross-sectional view of FIG. 6. The magnets 57 and 58 are held adjacent each other with their longitudinal axes parallel, and their upper and lower longitudinal pole faces being both co-planar and of opposite polarity with respect to the adjacent magnet. FIGS. 6 and 7 show that the upper surface 59 of magnet 57 is of "North" polarity, while the lower surface 61 of magnet 57 is of "South" polarity. Magnet 58, however, has an upper surface 59 of "South" polarity, and a lower surface 61 of "North" polarity.

Fixed upon both the upper and lower longitudinal faces of the magnets 57 and 58, are upper and lower planar metallic pole pieces 69 and 71. The pole pieces are substantially co-extensive with the adjacent longitudinal face of a magnet, but are preferably constructed slightly wider than a magnet face, affording upper and lower inner edges 72 and 73. As shown in FIG. 6, the inner edges 72 and 73 of pole pieces 69 and 71 are spaced relatively closer than the adjacent longitudinal sides 62 of the magnets. The close spacing of these inner edges acts to focus and concentrate the flux lines flowing from the magnet faces through the metallic pole pieces.

The adjacent longitudinal sides 62, and particularly the inner edges 72 and 73 of the pole pieces, are spaced apart a predetermined distance to define an elongated flux aperture extending the entire length of the magnets. The aperture 74 includes upper transverse flux lines and lower flux lines, indicated repectively by the numerals 76 and 77. Flux lines 76 and 77, concentrated by the pole pieces 69 and 71, flow between the adjacent opposite magnetic poles of the bar magnets 57 and 58.

Positioned within the elongated flux aperture 74 is a drive coil 78, constructed from conductive wire 79 arranged in an elongated planar configuration, as shown in FIGS. 6 and 8. The coil 78 is encapsulated in an insulated carbon fiber material 81 , or "KEVLAR", or any other non-conductive, lightweight material which can be molded and cured to form a rigid support structure. The material 81 not only maintains the coil and the attached diaphragm footing 82 as a rigid structure, but also prevents the wire 79 from shorting out, should the coil inadvertently come into contact with a pole piece during an overdrive condition. The footing 82 is preferably adhesively attached to a planar diaphragm 83, constructed from a lightweight substantially rigid material, as previously described.

It is important to note that the wire 79 is also configured in an elongated oval shape, having upper turns 84 and lower turns 86 (see FIG. 8). The upper turns 84 are located in a plane substantially intersected by upper flux lines 76, and the lower turns 86 are similarly positioned within a plane substantially intersected by lower flux lines 77. Such a configuration and location for the conductive wire 79 ensures that a high degree of coupling with the magnetic flux lines will exist for all normal drive conditions.

A drive amplifier (not shown), providing an electrical signal at an audio frequency, is connected to the plus (+) and minus (−) leads of the drive coil 78. As the coil is actuated, the fluctuating electro-magnetic field interacts with the static magnetic field represented by the upper and lower flux lines, causing the coil 78 and the attached diaphragm 83 to partake in front to rear excursions. The magnets, pole pieces and coil turns are respectively identical in size, configuration, number, and position, and the flux lines resulting from the mirrored construction of the bar magnets and the pole pieces are of equal density across respective portions of the flux aperture 74. Thus, the excursions of the diaphragms are linear and symmetrical, regardless of the direction of travel.

Figure 9:
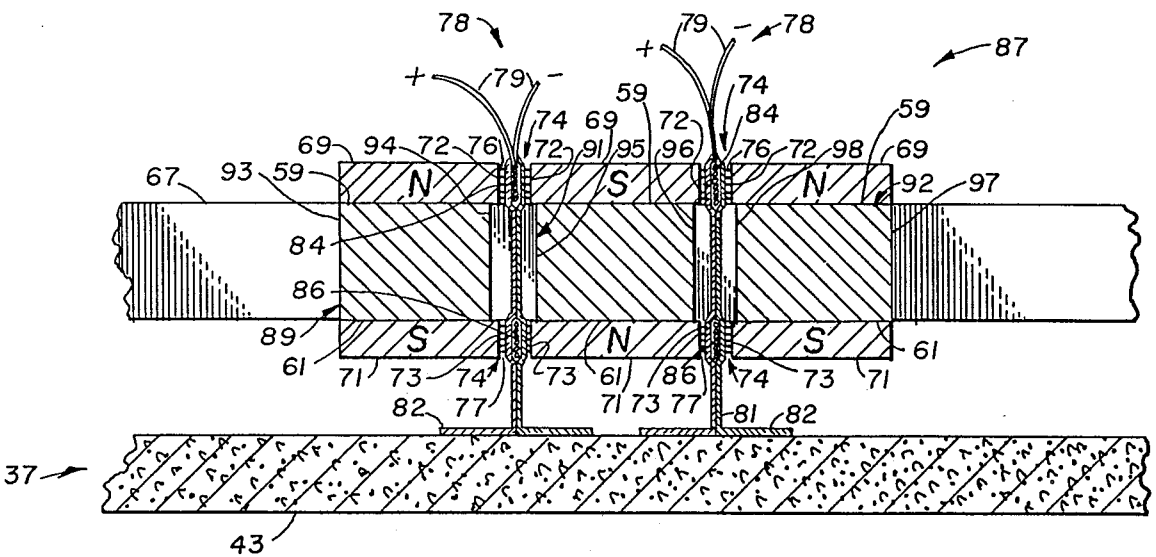
FIG. 9 is a transverse, cross-sectional view, to an enlarged scale, taken oh the plane indicated by the line 8—8 in FIG. 1, showing the prefered version of the electro-magnetic drive system.

Having discussed the basic form of the electromagnetic drive unit 56, a slightly more complicated drive unit 87, or second version, will now be presented. Drive unit 87 is shown in FIG. 9, which, in turn is a fragmentary cross-sectional view to a greatly enlarged scale, taken from FIG. 1. Thus, drive unit 87 represents the preferred form of the electro-magnetic drive system for the present invention. Since many of the components of the drive unit 87 are identical to those components already identified and discussed in the explanation given above regarding the first, most basic drive unit 56, these same numerical designations will be used hereafter, wherever appropriate, to describe the second drive unit 87 and a third drive unit 88, subsequently to be described. Also, since the respective constructions of the second and third versions of the drive unit are in many other ways identical to that of the basic drive unit 56, certain details of identical structures and features which are evident from the drawings will be discussed only generally for sake of brevity.

The drive unit 87 includes three substantially identical, elongated bar magnets 89, 91 and 92, having upper and lower longitudinal faces 59 and 61. Bar magnet 89 has an outer side 93 and an inner side 94, adjacent a first intermediate side 95 of magnet 91. Bar magnet 92 has an outer side 97 and an inner side 98, adjacent a second intermediate side 96 of magnet 91. To generate the proper flux patterns, the pole polarity of magnet 89 is opposite that of adjacent magnet 91, and identical to that of remote magnet 92 (see FIG. 9).

The magnets are held adjacent each other, with their longitudinal axes parallel, and their upper and lower longitudinal pole faces being both co-planar and of opposite polarity with respect to the adjacent magnet. Fixed upon both the upper and lower longitudinal faces of magnets 89, 91 and 92 are upper and lower planar pole pieces 69 and 71. These pole pieces are preferably of the size and configuration previously set forth, and similarly have inner edges 72 and 73 spaced so as to focus and concentrate the flux lines flowing between the magnets and through the pole pieces.

The adjacent sides of the magnets, and specifically the inner edges of the pole pieces, are spaced apart a predetermined distance to define a pair of elongated flux apertures 74 extending the entire length of the magnets. The apertures 74 include upper transverse flux lines 76 and lower flux lines 77, flowing between the adjacent, opposite magnetic poles of the bar magnets 89, 91 and 92.

The predetermined distance between the inner edges of the pole pieces must be as close as possible to enhance the density of the flux lines, while being sufficiently spaced freely to accommodate a respective drive coil 78. Each drive coil 78 used for the second drive unit 87 is identical to the coil 78 already described in FIGS. 6 and 8, used in association with the basic drive unit 56. Accordingly, each drive coil 78 shown in FIG. 9 includes conductive wire 79, encapsulated in a rigid support material 81, and a diaphragm footing 82 transversely positioned at one end for attachment in this case to the lower woofer diaphragm 43.

In each coil, the conductive wire 79 is configured to have upper turns 84 and lower turns 86, as previously identified and explained. Thus, the upper turns and the lower turns are located in a plane which substantially intersects the respective flux lines flowing between the adjacent pole pieces. In drive unit 87, the drive coils 78 must be driven out of phase with respect to each other, to cause both coils to react in phase with each other, and drive that attached diaphragm 43 in synchronism. This, of course, is necessitated by the fact that the magnetic poles of the adjacent pairs of magnets (89 and 91, and 91 and 92) are reversed with respect to each other.

When thus properly driven by an electrical signal, the drive unit 87 causes the diaphragm 43 to move forwardly and rearwardly, in response to the frequency and amplitude variations of the drive signal. It should be noted that each diaphragm footing 82 is equally spaced from the median, or center line of the diaphragm 43, ensuring that the fore and aft movement of the diaphragm is pistonic and linear in nature. It will also be appreciated that in the loudspeaker 11, a plurality of such drive units 87 is used to drive each diaphragm, providing a distributive and balanced driving force about and along the median longitudinal axis of the diaphragms.

FIG. 2 shows the assembly of drive units 87, as viewed from the rear of the speaker. Owing to the scale and perspective of FIG. 2, only the pole pieces 69 and the drive coils 78 can be seen. It should also be noted that the drive coils of the tweeter are shorter and lighter than those used to drive the midrange and woofer diaphragms, but they are otherwise identical in function and operation to the longer drive coils.

Figure 12:
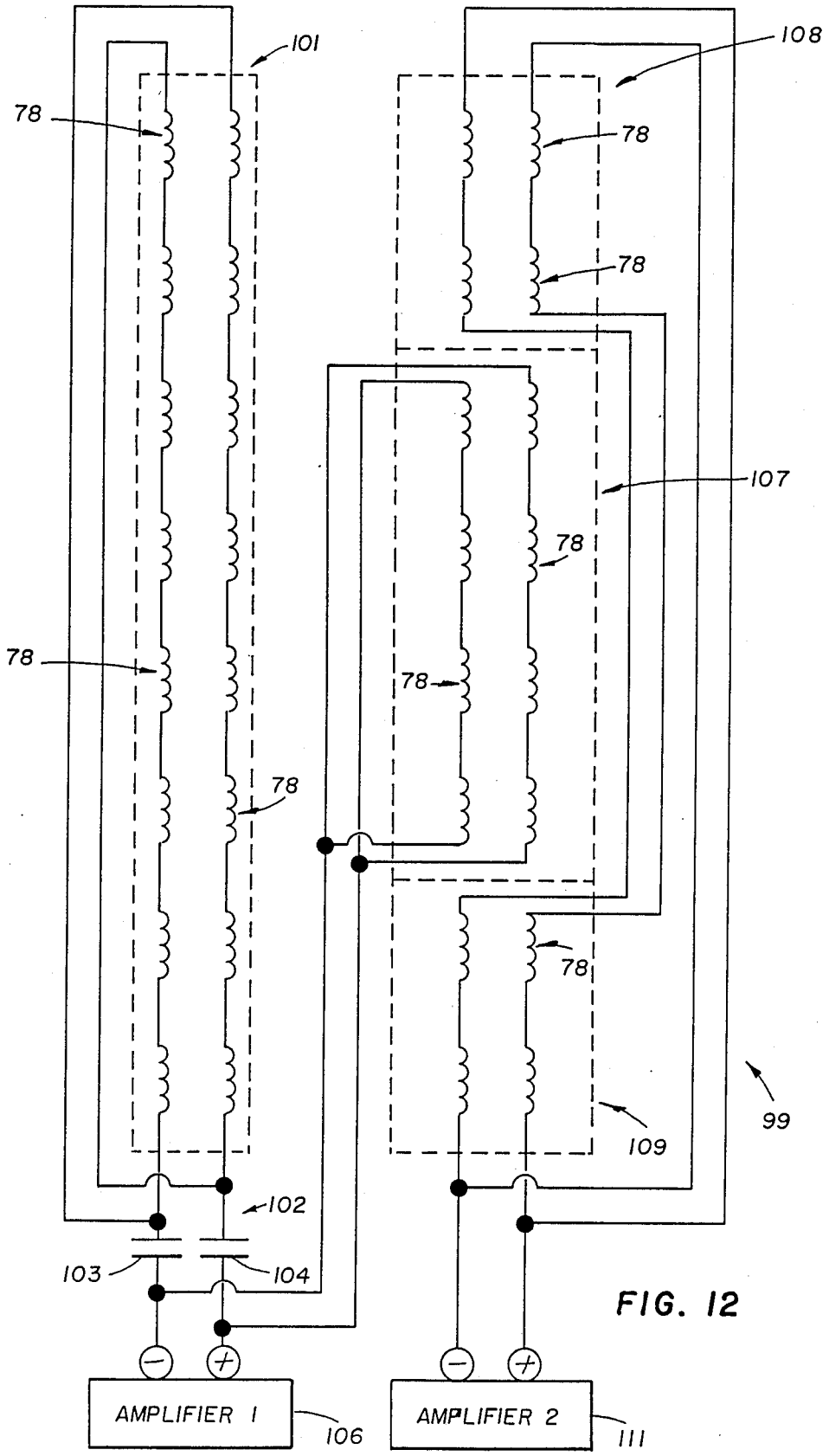

FIG. 12 shows a schematic diagram 99 of the loudspeaker in which the broken lines configured as a narrow, elongated rectangle, represent the tweeter assembly 101. Within the tweeter assembly are eight drive units 87, represented by the adjacent pairs of drive coils 78. As will be noted from the schematic, the drive coils 78 along each side of the tweeter are respectively connected in series, and then further connected out of phase and in parallel with the adjacent series of coils. The tweeter drive coils are then series connected through high pass filter 102, comprised of capacitors 103 and 104. The feed end of the capacitors is connected to the output terminals of amplifier 1, identified by the numeral 106.

Connected in parallel with the tweeter drive coils are four midrange drive units 87, represented by the drive coils 78. The midrange assembly 107, is similarly shown by broken lines configured as an elongated rectangle surrounding the drive coils. As with the tweeter coils, the midrange coils are connected in series/parallel fashion. It should be noted that the series/parallel interconnections shown in FIG. 12 result in a low overall speaker impedance, which is also very low in inductive reactance, owing to the fact that plural inductive loads are connected in series. The midrange diaphragm, which is capable of reproducing frequencies fairly smoothly into the mid-bass range, below 100 Hz, is fed a full range frequency signal.

An upper woofer assembly 108 and a lower woofer assembly 109 are likewise represented as elongated rectangles depicted in broken line in FIG. 12. As with the previously mentioned diaphragm assemblies, the woofer assemblies 108 and 109 contain schematic representations of each drive coil 78 employed to drive the diaphragms. In the case of the woofer diaphragms, two drive units 87 are used for each diaphragm. As is shown in the schematic, the eight drive coils 78 utilized to drive the upper and lower woofer diaphragms are connected series in phase, and parallel out of phase, so that the resultant action of the woofer diaphragms is in phase, as previously discussed. The upper and lower woofers are fed by a separate amplifier 2, identified by the numeral 111.

The program material delivered to amplifier 2 is solely low frequency in nature, say below 100 Hz, so that the upper and lower woofers are, in effect, performing as sub-woofers. However, the loudspeaker system 11 deviates somewhat from the traditional bi-amplified system in that the midrange diaphragm drive coils are fed with full range frequency information, since the midrange diaphragm has usable response below 100 Hz.

As has previously been discussed, and, as shown in FIGS. 1 and 2, the loudspeaker is preferably of such a height, that it extends substantially from the floor 13 to the ceiling 14. In a typical room, then, the loudspeaker 11 would have a total height of slightly less than 2.44 meters (eight feet). The placement of the upper woofer diaphragm 41 and the lower woofer diaphragm 43 in the loudspeaker is such that each "works" against an adjacent room boundary, the ceiling and the floor, respectively. Furthermore, the loudspeaker 11 is preferably located with its rear wall 17 parallel to and abutting the wall 15 of the listening room. The placement of the loudspeaker against the wall 15, combined with the locations of the upper and lower woofer diaphragms at the wall/ceiling and wall/floor conjunctions, acts to enhance the bass response of the system. In addition, the constructive interference between the frontal waves produced by the front of the woofer diaphragms, and the woofer backwaves emerging from the labyrinth ports, further augments the low frequency performance of the loudspeaker. Such constructive sound wave interference also creates an actual and a perceived integration of the various low frequency wave fronts, throughout the vertical height of the loudspeaker.

Having fully described the construction of second drive unit 87 and its mode of operation in driving the diaphragms of the preferred form of the loudspeaker 11, the third drive unit 88 will now be explained. Making specific reference to FIGS. 10 and 11, the drive unit 88 closely resembles the previously described electro-magnetic drive units, and has particular similarities with the basic drive unit 56. Rather than employing a single pair of bar magnets as drive unit 56, the third drive unit 88 uses two stacked pairs of elongated bar magnets, including upper magnets 112 and 113, and lower magnets 114 and 116. These magnets are identical in nature and configuration to bar magnets 57 and 58, previously identified. Thus, each magnet 112, 113, 114 and 116 has upper and lower longitudinal faces 59 and 61, upon which appropriate pole pieces, to be discussed below, are mounted.

Figure 10:
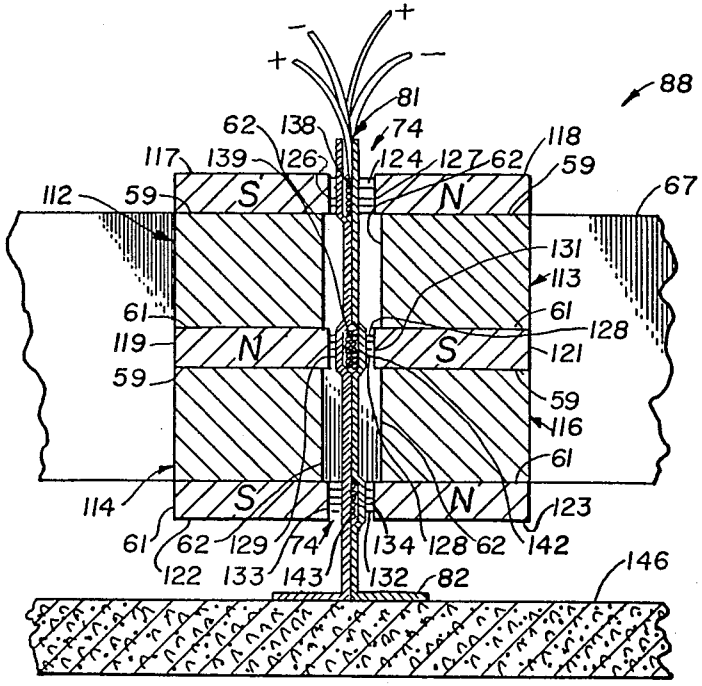
FIG. 10 is a transverse, cross-sectional view, taken to an enlarged scale, of a third embodiment of the electro-magnetic drive system, showing fragments of the associated support piece and planar diaphragm.

Drive unit 88 includes upper pole pieces 117 and 118, intermediate pole pieces 119 and 121, and lower pole pieces 122 and 123. FIG. 10 shows but a single mounting piece 67 to support and maintain the magnets and the pole pieces upon the frame of a loudspeaker, but typically a number of such pieces would be used, depending upon the number of drive units assembled in end-to-end or side-to-side relation. The magnets 112 and 113 are fixed adjacent each other with their longitudinal axes parallel, and their upper and lower longitudinal pole faces being both co-planar, and of opposite polarity with respect to the laterally adjacent magnet. Similarly, the lower magnets 114 and 116 are held next to each other with their longitudinal axes parallel, immediately beneath and vertically aligned, respectively, with upper magnet 112 and upper magnet 113.

The upper pole pieces 117 and 118 are fixed, respectively, upon the upper longitudinal faces 59 of the magnets 112 and 113. Intermediate pole piece 119 is sandwiched between the lower face 61 of magnet 112 and the upper face 59 of magnet 114; intermediate pole piece 121 is positioned between the lower face 61 of magnet 113 and the upper face 59 of magnet 116. FIG. 10 reveals that the polarities of the adjacent stacked pairs of magnets, the first stacked pair including magnets 112 and 114 and the second stacked pair including magnets 113 and 116, are reversed with respect to each other. And, the polarities of the magnets within a particular stacked pair are such that the proximate poles are like and the distal poles are like. Thus, for example, the lower face 61 of magnet 112 and the proximate upper face 59 of magnet 114 are both of "North" polarities, and, the upper face 59 of magnet 112 and the distal lower face of magnet 114 are both of "South" polarities.

As discussed in detail above, the close spacing of the inner edges of the pole pieces acts to focus and concentrate the flux lines flowing from the magnet faces through the pole pieces. FIG. 10 shows upper flux lines 124 between inner edges 126 and 127, intermediate flux lines 128 between inner edges 129 and 131, and lower flux lines 132 between inner edges 133 and 134.

Figure 11:
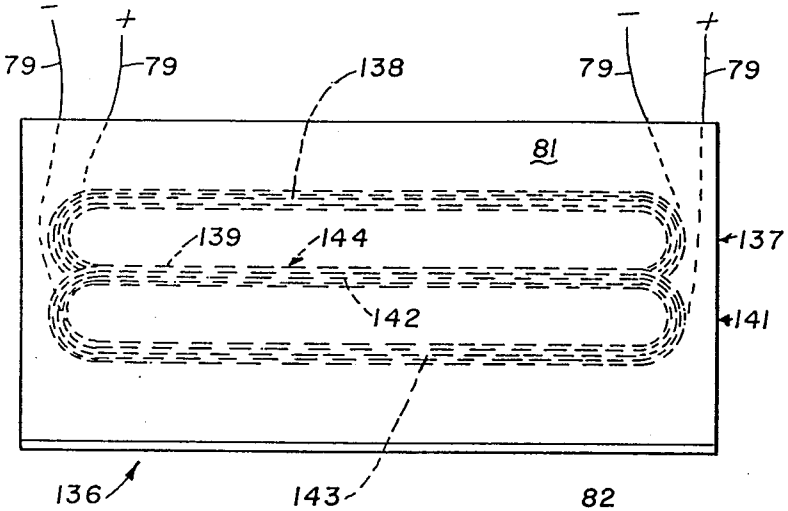
FIG. 11 is a side elevational view of the elongated moving coil assembly of FIG. 9, the dual stacked, and partially overlapped oval coils being shown in broken line; and, FIG. 12 is a pictorial representation of the electrical schematic of the preferred form of the invention, the broken lines representing outlines of the tweeter, midrange, and upper and lower woofer diaphragms, in accordance with the general layout of these diaphragms as shown in FIG. 1.

As with the other embodiments of the electro-magnetic drive unit, the adjacent longitudinal sides 62 of the magnets, and especially the various inner edges of the pole pieces of the drive unit 88 are spaced apart a predetermined distance to define an elongated flux aperture 74, extending the length of the magnets. Posited within the flux aperture 74 is a dual element drive coil 136, shown particularly in FIGS. 10 and 11. The drive coil 136 includes a first elongated coil loop 137 having upper wire turns 138 and lower wire turns 139, and a second elongated coil loop 141 having upper wire turns 142 and lower wire turns 143. As shown in FIG. 11, the turns 138 are uppermost, the turns 139 and 142 overlap (see FIG. 10) collectively to form intermediate turns 144, and the turns 143 are lowermost. The drive coil 136 thus presents uppermost, intermediate, and lowermost turns of wire in a plane substantially intersected, respectively, by upper flux lines 124, intermediate flux lines 128, and lower flux lines 132.

Also, drive coil 136 is encapsulated in the previously discussed lightweight, insulative material 81, which, when molded and hardened about the coil loops, forms a rigid support structure. Diaphragm footing 82 is attached to the lowermost end of coil support structure, acting to interconnect the structure and a diaphragm 146. The conductive wire 79 is connected to a drive amplifier so that the coil loops 137 and 141 are fed out of phase, resulting in synchronous, or in phase interaction between the electromagnetic fields generated and the existing flux lines flowing between the pole pieces. The diaphragm 146 is thus driven to partake in fore and aft, pistonic movement in response to the drive signal.

It is evident that further versions or iterations of the basic electro-magnetic structures disclosed herein could readily be configured, through the expedient of stacking additional magnets and providing corresponding turns in the drive coils for greater drive force, or by adding additional lateral gangs or groupings of magnets and corresponding coils to provide multiple drive structures.

I claim:

1. Cooperating coil and magnet means for driving a diaphragm in a loudspeaker, comprising:

a. a pair of substantially identical, elongated bar magnets, having upper and lower longitudinal faces adjacent and remote longitudinal sides, and opposing transverse ends, each of said magnets having opposing magnetic poles upon respective said upper and lower faces;

b. means for adjacently mounting said magnets upon the frame of the loudspeaker with the longitudinal axes of said magnets being parallel, said upper and lower longitudinal pole faces of said magnets being both co-planar and of opposite polarity with respect to the adjacent magnet, and the adjacent longitudinal sides of said magnets being spaced apart a pre-determined distance to define an elongated flux aperture having upper transverse flux lines and lower transverse flux lines passing between said adjacent opposite magnetic poles;

c. a coil of conductive wire, arranged in an elongated planar configuration and positioned within said elongated flux aperture, said coil having upper turns of wire located in a plane substantially intersected by said upper flux lines, and having lower turns of wire located in a plane substantially intersected by said lower flux lines;

d. substantially rigid support means for maintaining said coil in a planar configuration, said support means being connected to the speaker diaphragm for driving the loudspeaker when an electrical signal is impressed upon said coil.

2. An apparatus as in claim 1; further including means for focusing and concentrating said upper and lower flux lines.

3. An apparatus as in claim 2 in which said means for focusing and concentrating flux lines comprises a metallic planar pole piece mounted upon each of said upper and lower longitudinal faces of said bar magnets, the inner edges of adjacent pole pieces of opposing magnetic polarity being spaced relatively closer than said adjacent longitudinal sides of said bar magnets.

4. An apparatus as in claim 3 in which said upper and lower turns of said coil are located between respective said inner edges of adjacent pole pieces.

5. Cooperating coil and magnet means for driving a diaphragm in a loudspeaker, comprising:

a. first, second, and third substantially identical, elongated bar magnets, having upper and lower longitudinal faces and longitudinal sides, each of said magnets further having opposing magnetic poles upon respective said upper and lower faces;

b. means for adjacently mounting said magnets upon the frame of the loudspeaker with the longitudinal axes of said magnets being parallel, said upper and lower longitudinal pole faces of said magnets being both co-planar and of opposite polarity with respect to an adjacent said magnet, and the adjacent longitudinal sides of said magnets being spaced apart a pre-determined distance to define a pair of elongated flux apertures, each of said apertures having upper transverse flux lines and lower transverse flux lines passing between said adjacent opposite magnetic poles;

c. a pair of coils conductive wire, each of said coils arranged in an elongated planar configuration and positioned within a respective said elongated flux aperture, each of said coils having upper turns of wire located in a plane substantially intersected by respective said upper flux lines, and having lower turns of wire located in a plane substantially intersected by respective said lower flux lines;

d. substantially rigid support means for maintaining each of said coils in a planar configuration, said support means being connected to the speaker diaphragm for driving the loudspeaker when said coils are driven out of phase with respect to each other by an electrical signal.

6. An apparatus as in claim 5, further including means for focusing and concentrating said upper and lower flux lines.

7. An apparatus as in claim 6, in which said means for focusing and concentrating flux lines comprises a metallic planar pole piece mounted upon each of said upper and lower longitudinal faces of said bar magnets, the inner edges of adjacent pole pieces of opposing magnetic polarity being spaced relatively closer than said adjacent longitudinal sides of said bar magnets.

8. An apparatus as in claim 7, in which said upper and lower turns of said coils are located between respective said inner edges of adjacent pole pieces.

9. Cooperating coil and magnet means for driving a diaphragm in a loudspeaker, comprising:

a. two stacked pairs of substantially identical elongated bar magnets, each of said pair including an upper magnet and a lower magnet having upper and lower longitudinal faces and adjacent and remote longitudinal sides, and each of said magnets having opposing magnetic poles upon respective said upper and lower faces;

b. means for laterally and adjacently mounting said stacked pairs of magnets upon the frame of the loudspeaker with the longitudinal axes of said magnets being parallel, said upper and lower longitudinal pole faces of laterally adjacent magnets being both co-planar and of opposite polarity with respect to each other, said upper and lower longitudinal pole faces of respective upper and lower magnets within each respective said pair being arranged such than proximate poles are of like polarity and distal poles are of like polarity, the adjacent longitudinal sides of laterally adjacent magnets being spaced apart a pre-determined distance to define an elongated flux aperture having upper flux lines, intermediate flux lines, and lower flux lines passing between said adjacent opposite magnetic poles;

c. a drive coil, including a first elongated coil loop having upper wire turns and lower wire turns, and a second elongated coil loop having upper wire turns and lower wire turns, said first and second coil loops being vertically stacked and substantially co-planar so that said lower wire turns of said first loop overlap said wire turns of said second loop collectively to form intermediate turns, said upper wire turns of said first loop located in a plane substantially intersected by said upper flux lines, said intermediate turns located in a plane substantially intersected by said intermediate flux lines, and said lower wire turns of said second loop located in a plane substantially intersected by said lower flux lines;

d. substantially rigid support means for maintaining said drive coil in a planar configuration, said support means being connected to the speaker diaphragm for driving the loudspeaker when said first and second coil loops are driven out of phase with respect to each other by an electrical signal.

10. An apparatus as in claim 9 further including means for focusing and concentrating said upper, intermediate, and lower flux lines.

* * * * *